United States Patent [19]

Kornaker

[11] 4,377,767

[45] Mar. 22, 1983

[54] DEVICE FOR ADJUSTING THE ELECTRON BEAMS OF A COLOR-PICTURE TUBE

[75] Inventor: Walter Kornaker, Berkheim, Fed. Rep. of Germany

[73] Assignee: International Standard Electric Corporation, New York, N.Y.

[21] Appl. No.: 221,586

[22] Filed: Dec. 31, 1980

[30] Foreign Application Priority Data

Jan. 30, 1980 [DE] Fed. Rep. of Germany ..... 3003197

[51] Int. Cl.[3] ..... H01J 29/50

[52] U.S. Cl. ..... 313/412; 313/409

[58] Field of Search ..... 313/412, 409

[56] References Cited

U.S. PATENT DOCUMENTS

| | | | |
|---|---|---|---|
| 3,268,753 | 8/1966 | Hughes | 313/412 |
| 3,614,502 | 10/1971 | Doggett | 313/412 |
| 4,119,884 | 10/1978 | Bumenberg et al. | 313/414 |

FOREIGN PATENT DOCUMENTS 2612607 12/1979 Fed. Rep. of Germany .

*Primary Examiner*—Harold A. Dixon

*Attorney, Agent, or Firm*—John T. O'Halloran

[57] ABSTRACT

To adjust the convergence, raster and purity of an in-line color-picture tube, an oval magnetizable wire ring is mounted on the electron-gun system in such a way that its long axis lies in the plane of the electron beams. This arrangement permits both the conventional joint movement of the electron beams and movement of the beams independently of each other.

9 Claims, 8 Drawing Figures

DEVICE FOR ADJUSTING THE ELECTRON BEAMS OF A COLOR-PICTURE TUBE

BACKGROUND OF THE INVENTION

In the present-day shadow-mask color-picture tubes, the three electron beams produced by such an electron-gun system must be adjusted so that all three beams intersect at the same opening in the shadow mask. This adjustment is called "convergence adjustment". The simplest method is to move the three electron beams individually, as is described, for example, in German Patent DE-OS NO. 27 22 477. With an assembly as disclosed in that publication, it is easy to move each electron beam virtually independently of each of the other two beams. Besides this single-beam movement, however, it is also possible to move all three electron beams jointly in the electron-beam plane to adjust purity, and perpendicular to the electron-beam plane to adjust the raster. However, the overall structure is rather complicated, unstable and costly.

German Patent DE-OS No. 26 12 607 discloses another device for adjusting the convergence, purity and raster of a color-picture tube, which device is located inside the tube neck. A circular wire or strip ring is mounted in the region of the electron-gun system and so magnetized from outside that the electron beams are adjusted as desired. Through the use of a single circular wire ring which is closed except for an air gap, the construction described is very simple and stable. However, it is not possible to move the electron beams independently of each other.

SUMMARY OF THE INVENTION

The present invention relates to a device for adjusting the convergence, purity, and raster of a color-picture tube having an electron-gun system disposed in its neck and producing three coplanar electron beams.

The object of the invention is to provide a device for adjusting the convergence, purity, and raster of a color-picture tube having an electron-gun system disposed in its neck and producing three coplanar electron beams, which device is constituted by a wire or strip ring which is attached to the electron-gun system, is magnetizable from outside, is closed except for at least one air gap, and encloses an area perpendicular to the electron-beam plane and symmetrical about the point where the central electron beam passes through this area, which device makes it possible to adjust the electron beams essentially independently of each other while being simple in construction, stable, and easy to install.

This object is achieved as set forth in the first claim. Use is made of an elongated wire or strip ring whose long axis lies in the electron-beam plane and whose short axis is perpendicular thereto. By this adaptation of the geometry of the ring to the coplanar electron beams, considerably improved movability of the electron beams and particularly movability of the beams nearly independently of each other can be achieved. The long sides of the wire ring may extend parallel to each other, which permits especially simple mounting on the outside of or in a cup-shaped electrode common to all three electron beams.

Depending on the design of the electron-gun system or of the magnetizing unit required for magnetizing the ring, it has proved advantageous to slightly modify the shape of the ring, particularly by causing the distance between the parallel long sides to decrease from the outside toward the center or by dividing the long sides into three portions of about the same length, with the distance between the long sides in the outer portions being greater than that in the central portion.

If the ring is placed in a cup-shaped electrode having a cross-sectional shape corresponding to the shape of the ring, it is advantageously of one-piece construction, has an air gap, and is fitted into the electrode in a resilient manner. The ring is prevented from falling out of the electrode by indentations subsequently made in the electrode. Particularly with more complicated shapes of the ring, the latter is advantageously of two-piece construction and has two air gaps, the two pieces being mounted separately from each other by indentations, tongues stamped from the electrodes or welding.

BRIEF DESCRIPTION OF THE DRAWINGS

Embodiments of the invention will now be described in greater detail with reference to the accompanying drawings, in which.

DETAILED DESCRIPTION OF THE INVENTION

Figure 1:
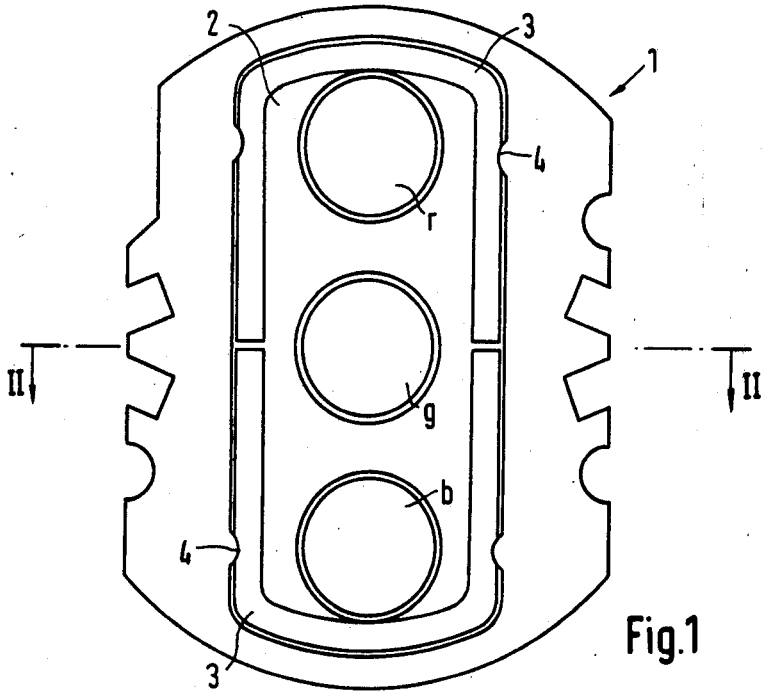
FIG. 1 is a view into a cup-shaped electrode which is common to three electron beams and contains a magnetizable ring according to the invention.
Figure 2:
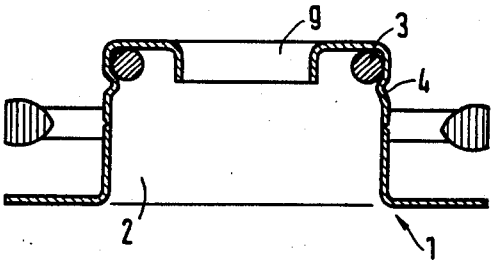
FIG. 2 is a section taken along line II—II of FIG. 1.

FIGS. 1 and 2 show a cup-shaped electrode 1. The electrode is drawn to scale and corresponds to a part of a focusing electrode of a conventional electron-gun system. The oval cup 2 has three openings for the electron beams r, g, b. r means that this electron beam excites red stripes on the luminescent screen of the color-picture tube. The two other electron beams g and b excite green and blue phosphor stripes, respectively. The cup of this electrode contains a two-part wire ring 3 of round cross-section, which is mounted in the sidewalls of the cup-shaped electrode by indentations 4. The ring 3 is made of a materal commonly used for such purposes. The dimensions of the ring and of the entire electrode are apparent from the drawing, the distance between the long parallel walls of the cup 2 being about 9.4 mm.

Figure 3:
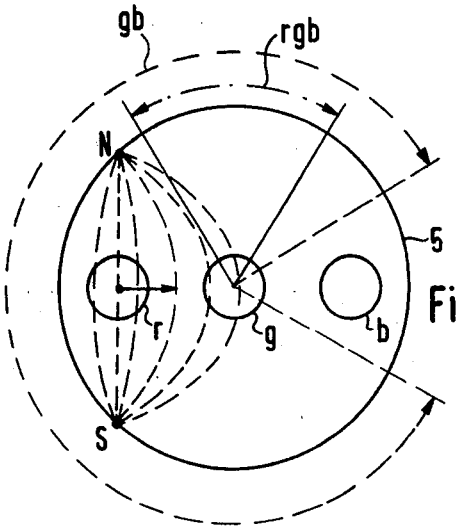
FIG. 3 shows the zones of influence of a magnetization on several electron beams with a conventional electron-beam-adjusting device.

The influence of a magnetic field on the three electron beams in a conventional arrangement and in an arrangement according to the invention will now be described with the aid of FIGS. 3 and 4, respectively. FIG. 3 shows a circular wire ring 5 which surrounds three coplanar electron beams r, g, b. Shown on the magnetizable ring are two magnetic poles N and S, which are located, respectively, exactly above and below the left electron beam r. By the field thus produced, this electron beam r is deflected toward the right. By strengthening or weakening the field or by reversal of polarity, the electron beam can be moved by different amounts and in different directions. The magnetization shown has been chosen at will. The real magnetization is, of course, dependent on the direction in which the electron beam must actually be moved.

It can be seen that the field shown acts not only on the left electron beam r but also on the central electron beam g. The field strength and, hence, the adjusting force exerted on an electron beam decreases as the square of the distance to the poles. In the following consideration of the dependence of the movement of two or all three electron beams under a certain magnetization, the movements are regarded as being essentially independent of each other if the electron beams not to be moved are displaced only one third or less and one third as much as the electron beam to be adjusted. Looking at the magnetic poles N and S as shown, i.e., located on the magnetic ring directly above and below the left electron beam r, respectively, it follows from the adjusting force decreasing in inverse proportion to the square of the pole-to-beam distance that the central beam, g, is displaced about half as much as the left beam, r, while the right beam, b, is displaced about one quarter as much as the beam r.

FIG. 3 also shows the angular ranges within which all three or only two electron beams are moved interdependently. If magnetization is effected within an angular range r g b of about 60°, shown in FIG. 3 at the top, all three beams are moved interdependently. The corresponding angular range also extends over the lower portion of the magnetized ring, of course. Analagously to the above definition of "independence", a beam is considered to be moved dependent upon another beam if it is moved at least one third more than the other beam. In an angular range gb (indicated by a broken line), the beams g and b can be moved only interdependently. This angular range includes about 300°.

On the other side of the vertical symmetry axis of the arrangement, there is, of course, the same angular range rg, within which the electron beams r and g can be moved only interdependently. It can thus be seen that in this arrangement, there is no range on the entire magnetizable circular wire ring within which an electron beam could be moved completely independently of at least one second electron beam, assuming, as mentioned above, that a movement of one beam is independent of a second beam if the latter is displaced not more than one third as much as the first beam.

Figure 4:
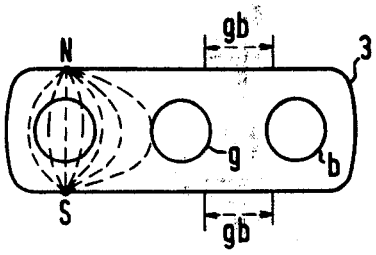
FIG. 4 shows the zones of influence of a magnetization on different electron beams with a device according to the invention.

FIG. 4 shows those regions of a magnetizable, elongated wire ring according to the invention within which two or even three electron beams are moved interdependently when the ring is magnetized. It can be seen that there is no region on the entire ring in which all three electron beams are moved interdependently. There are only two short regions gb within which the electron beams g and b are moved interdependently. Analagously to FIG. 3, there are two additional regions rb, which are not shown in FIG. 4, either.

From the foregoing it is readily apparent that the adaptation of the magnetizable wire ring to the geometry of the coplanar electron beams gives a considerable improvement over the conventional circular ring. The individual electron beams can be adjusted practically independently of each other. This provides a considerable saving of time when the convergence, purity and raster of a color-picture tube are adjusted. The device according to the invention is simple in construction and stable and can be firmly mounted in or on the electrodes of conventional electron-gun systems. The new possibility of moving the electron beams essentially independently of each other to adjust convergence using a simple constructional arrangement does not, of course, preclude a joint movement of the beams for adjusting purity and raster. The possibility of joint movement is thus preserved, while the possibility of independent movement despite structural simplicity is added as an advantageous feature.

Figure 5A:
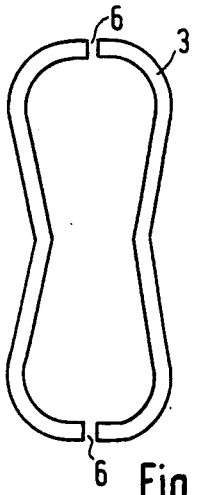
FIGS. 5*a* to 5*c* show different embodiments of a magnetizable ring according to the invention.
Figure 5B:
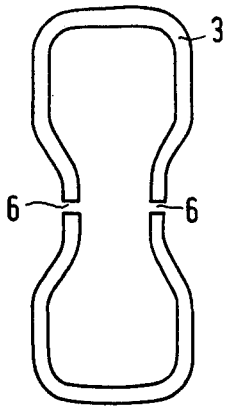
Figure 5C:
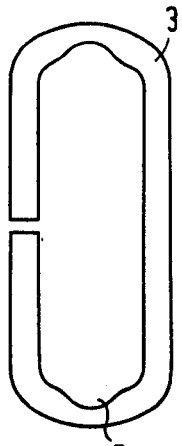

FIGS. 5*a* to 5*c* show different embodiments of devices according to the invention. Since an apparatus for magnetizing the wire ring 3 must be placed around the circular neck of a color-picture tube, those regions of the wire ring according to the invention which are close to the central electron beam are very far from the magnetizing apparatus because of the geometry of the ring. As a result, the coupling to those regions of the wire ring which are close to the central electron beam is not as close as the coupling to the regions close to the outer beams. It has turned out that with a magnetizing apparatus of symmetrical design, this results in the central-electron beam being movable less than the outer beams. This shortcoming can be offset either by a magnetizing apparatus of asymmetrical design or by devices as shown in FIGS. 5*a* and *b*. FIG. 5*a* shows an embodiment of a wire ring 3 in which the distance between the long sides of the ring decreases from the outside toward the center, i.e., toward the central electron beam g. As a result, magnetic poles on the ring are shifted toward the central electron beam g, thus permitting this beam g to be moved to the same extent as the outer beams. The wire ring of FIG. 5*a* is divided into two parts which, when being fitted in the cup of an electrode, are put together and form air gaps 6. FIG. 5*b* shows an embodiment of a wire ring 3 whose long sides are divided into three portions of about the same length, the distance between the long sides in the outer portions being greater than that in the central portion. The effect of this device is the same as that described with reference to FIG. 5*a*. The magnetic poles on the magnetic wire are moved closer to the central electron beam. The ring is again composed of two parts separated by air gaps 6. Other modifications may be made, of course; they largely depend on the internal structure of the electrodes used and on the shape of the magnetic ring used. FIG. 5*c* shows a ring with a greater gauge of wire than that shown so far. A comparison with FIG. 1 shows that if the thickness of the wire ring shown there was simply increased, the openings for the outer electron beams would be partly covered by the ring. In FIG. 5*c*, therefore, notches 7 are provided in the ring in those areas where the ring would cover these openings.

Figure 6:
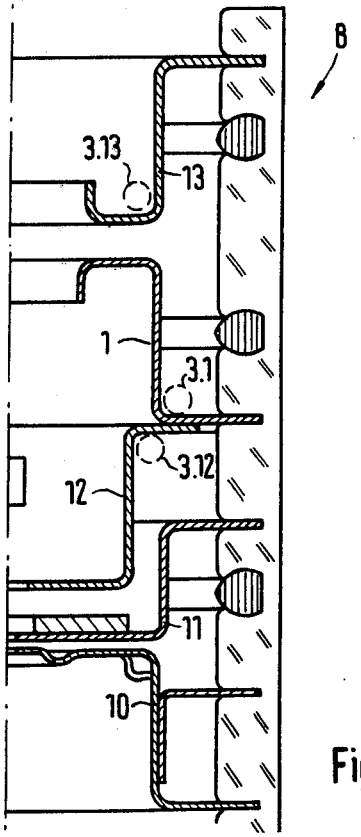
FIG. 6 is a longitudinal section through an electron-gun system having electrodes each common to three electron beams and having magnetizable rings according to the invention attached thereto.

FIG. 6 is a sectional view of an electron-gun system 8 with cup-shaped electrodes. The electrode 1 is the one shown in more detail in FIGS. 1 and 2. The other electrodes are designated 10 to 13. The electrode 10 is the grid, cylinder and the electrode 11 is the control grid. The electrode 12 forms the lower part of the focusing grid, whose upper part is formed by the electrode 1, and the anode grid is designated 13. The electron-gun system is closed by a circular convergence cup (not shown). A selection of further possible locations of wire rings 3 is indicated by broken lines. The wire ring 3.12 is located on the outside of the electrode 12. The wire ring 3.1 is located on the outside of the electrode 1, and the wire ring 3.13 is disposed inside the electrode 13. The location inside the electrode 1 was already shown in FIGS. 1 and 2. The wire ring may also be attached to other electrodes on the inside or outside thereof and particularly in the circular convergence cup. In all figures, the wire rings 3 are shown as round wires because the commercially available magnetic materials usually have this cross-sectional shape. It is, of course, also possible to use a wire of rectangular or any other cross-section. The wire rings are mounted by indentations 4 as shown, for example, in FIG. 2 by tongues stamped from the electrodes, or by welding. However, the respective mounting method chosen has nothing to do with the invention and involves routine work as is usual in the art.

I claim:

1. A device for adjusting the convergence, purity and raster of a color-picture tube having an electron-gun system disposed in its neck and producing three coplanar electron beams which device comprises elongated means attached to the electron-gun system which is magnetizable from outside, wherein said means is closed except for at least one air gap, said means encloses a non-circular area perpendicular to the electron-beam plane and symmetrical about the point where the central electron beam passes through said area, and said area has a long axis lying in the electron-beam plane and a short axis perpendicular thereto.

2. A device as claimed in claim 1, wherein said area has long sides which extend generally parallel to each other.

3. A device as claimed in claim 2, wherein the long sides are divided into three portions of about the same length and the distance between the long sides at the ends is greater than that in the central portion.

4. A device as claimed in claim 1, wherein said area has long sides and distance between said long sides decreases from the ends toward the central portion.

5. A device as claimed in any one of claims 1 to 4, wherein the means is located inside the convergence cup of an electron-gun system.

6. A device as claimed in claim 1 or 2, wherein the means is attached to the outside of a cup-shaped grid of an electron-gun system having grids, each of which is common to all three electron beams.

7. A device as claimed in any one of claims 1 to 4, wherein the means is mounted in a cup-shaped grid of an electron-gun system having grids, each of which is common to all three electron beams.

8. A device as claimed in any one of claims 1 to 4, wherein the means is of one-piece construction and has an air gap.

9. A device as claimed in any one of claims 1 to 4, wherein the means is of two-piece construction and has two air gaps.

* * * * *